US005841061A

United States Patent [19]

Westfall et al.

[11] Patent Number: 5,841,061

[45] Date of Patent: Nov. 24, 1998

[54] AIR-FUEL AERIAL FIREWORKS DISPLAY DEVICE

[76] Inventors: Robert L. Westfall, 2632 Pin Oak, Plano, Tex. 75025; Robert D. McMurray, 1329 Bluebird La., Midlothian, Tex. 76065

[21] Appl. No.: 905,684

[22] Filed: Aug. 4, 1997

[51] Int. Cl.[6] ..... F42B 4/04

[52] U.S. Cl. ..... 102/361; 102/363; 102/365

[58] Field of Search ..... 102/335, 361, 102/363, 365

[56] References Cited

U.S. PATENT DOCUMENTS

| | | | |
|---|---|---|---|
| H161 | 11/1986 | Sullivan, Jr. | 102/363 |
| H1457 | 7/1995 | Sullivan, Jr. | 102/324 |
| 2,086,618 | 7/1937 | Hitt | 102/361 X |
| 2,501,766 | 3/1950 | Fieser et al. | 102/365 |
| 2,630,066 | 3/1953 | Ponder et al. | 102/365 |
| 2,641,292 | 6/1953 | Quillinan | 102/365 |
| 2,817,294 | 12/1957 | Hjellnes | 102/361 |
| 2,993,441 | 7/1961 | Griffith et al. | 102/20 |
| 4,157,928 | 6/1979 | Falterman et al. | 149/109.2 |
| 4,392,432 | 7/1983 | Fenrick et al. | 102/365 |
| 4,576,094 | 3/1986 | Meador | 102/202.12 |
| 4,630,540 | 12/1986 | Trocino | 102/307 |
| 5,138,948 | 8/1992 | La Mura et al. | 102/335 |
| 5,331,896 | 7/1994 | Sullivan, Jr. | 102/322 |
| 5,627,338 | 5/1997 | Poor et al. | 102/361 |

*Primary Examiner*—Peter A. Nelson
*Attorney, Agent, or Firm*—Konneker & Smith, P.C.

[57] ABSTRACT

An aerial fireworks display device includes a plastic bottle for holding a quantity of combustible liquid, such as diesel fuel, and a one piece plastic lid structure which is threadable onto the bottle and has an open-topped depending well portion in which a quantity of flash powder may be placed. After the flash powder has been placed in the lid well portion a fuse-containing plug structure is snap-fitted into the top end of the lid well. The diesel fuel is poured into the bottle and the lid is screwed onto the bottle so that the flash powder-containing well extends into the bottle interior, and a portion of the fuse extends outwardly through the upper end of the plug structure. The assembled device may then be inverted and placed in a mortar tube for launching.

16 Claims, 1 Drawing Sheet

AIR-FUEL AERIAL FIREWORKS DISPLAY DEVICE

BACKGROUND OF THE INVENTION

The present invention generally relates to recreational fireworks display devices and, in a preferred embodiment thereof, more particularly relates to a specially designed container structure which is used in the construction of an air-fuel aerial recreational fireworks display device.

A conventional air-fuel aerial fireworks display device is typically constructed using a plastic bottle, with screw cap, containing a quantity of liquid fuel and a fused dispersal charge. The bottle cap is perforated to allow the dispersal charge fuse to extend from inside of the bottle to the outside of the cap. The fused dispersal charge is a sealed cardboard tube filled with flash powder that is ignited by a fuse through one end seal. The outside diameter of the cardboard tube is sized to pass through the bottle mouth.

The fuse is located in one end of the cardboard tube and held in place with hot glue, which completely seals the tube end. The other tube end is completely sealed with hot glue.

This typically constructed conventional display device is assembled by inserting the fuse of the preassembled and sealed dispersal charge through the hole in the bottle cap. The fuse is sealed to the bottle cap and the cardboard tube is secured to the inside of the bottle cap with hot glue. The cardboard tube is inserted through the mouth of the bottle in a manner placing a lower longitudinal portion of the cardboard tube into the fuel and secured in place with the screw cap.

To launch the assembled device, a conventional cardboard mortar tube structure is used. A bottom interior end portion of the mortar tube is filled with black powder with which an end of a main fuse is communicated. The assembled air-fuel device is then inverted and dropped into the top end of the mortar tube, thereby placing the previously upper fuse end of the device in the black powder in the bottom interior end portion of the mortar tube.

The main fuse extending into the mortar tube into the black powder therein is then lit to ignite the black powder which, in turn, (1) lights the fuse extending into the cardboard tube, and (2) launches the device upwardly out of the open upper end of the mortar tube and high into the air. When the expelled device is high in the air, its burning fuse ignites the flash powder within the cardboard tube which creates a mid-air "salute" explosion. The salute explosion, in turn, ignites the fuel within the plastic bottle to create a mid-air "fire ball", the device thus having been referred to as a "lampare".

This conventionally constructed fireworks display device has several disadvantages. For example, the hot melt glue heretofore required to seal the ends of the cardboard flash power tube, and to seal the juncture between the tube and the lid hole through which it extends, is rather difficult, cumbersome and time-consuming to work with. Additionally, the device simply does not lend itself for multiple construction and use by a single display operator. This is due to the fact that the device has to be made up immediately before its use so that the gasoline or other flammable liquid does not soak through the cardboard tube into the flash powder. Accordingly, it is difficult for a single display operator to simultaneously launch a group of the devices.

As can readily be seen from the foregoing, it would be desirable to provide an improved air-fuel aerial fireworks display device in which the disadvantages of the above-described conventionally constructed fireworks display device are eliminated or at least substantially reduced. It is accordingly an object of the present invention to provide such an improved device.

SUMMARY OF THE INVENTION

In carrying out principles of the present invention, in accordance with a preferred embodiment thereof, an improved aerial fireworks display device is provided which comprises a container adapted to receive a first combustible material, representatively a combustible liquid such as diesel fuel or gasoline, and having an open end portion. Preferably the container is a plastic bottle. A lid structure is also provided, and has an upper portion removably and sealingly securable to the open end portion of the container, and a hollow well portion depending from the upper portion and adapted to receive a second combustible material, representatively flash powder. The hollow well portion has a closed lower end, and an upper interior portion that opens outwardly through the upper lid portion. Preferably, the lid structure is of a one piece plastic construction.

The device also includes a plug member having top and bottom ends and an interior chamber opening outwardly through its top and bottom ends. A bottom end portion of the plug member is removably insertable downwardly into the upper interior portion of the lid structure well. A fuse is provided and has a longitudinally intermediate portion captively retained in the plug member chamber, with top and bottom end portions of the fuse respectively exposed at the top and bottom ends of the plug member.

Cooperating means are provided on the bottom end portion of the plug member and on the lid structure well for removably and sealingly retaining the bottom end portion of the plug member within the upper interior portion of the lid structure well. Preferably, these cooperating means are operative to provide a snap-fit connection between the plug and the well, in response to downward movement of the plug into the well, and are defined by an annular exterior flange formed on the bottom end of the plug, and an annular interior flange formed within an upper end portion of the well. When the lower end portion of the plug is downwardly inserted into the well, the plug flange snaps downwardly past and underlies the interior well flange.

To assemble the device and ready it for launching, flash powder, or similar material, is placed in the lid well and the fuse-containing plug structure is snap-fitted into the top end of the lid well. Diesel fuel, or another combustible fuel such as gasoline, is poured into the bottle and the lid is screwed onto the bottle so that the flash powder-containing well extends into the bottle interior, and a portion of the fuse extends outwardly through the upper end of the plug structure. The assembled device may then be inverted and placed in a mortar tube for launching.

DETAILED DESCRIPTION

Figure 1:
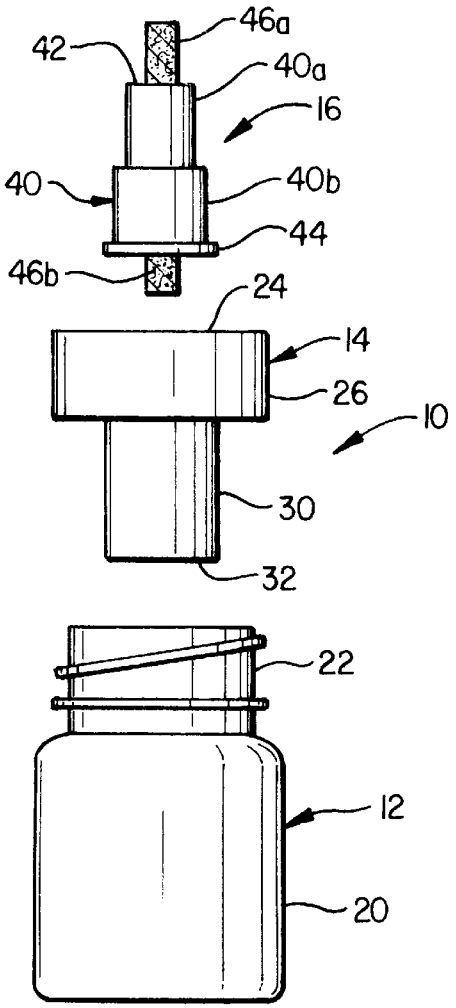
FIG. 1 is an exploded side elevational view of an air-fuel aerial fireworks display device embodying principles of the present invention.
Figure 2:
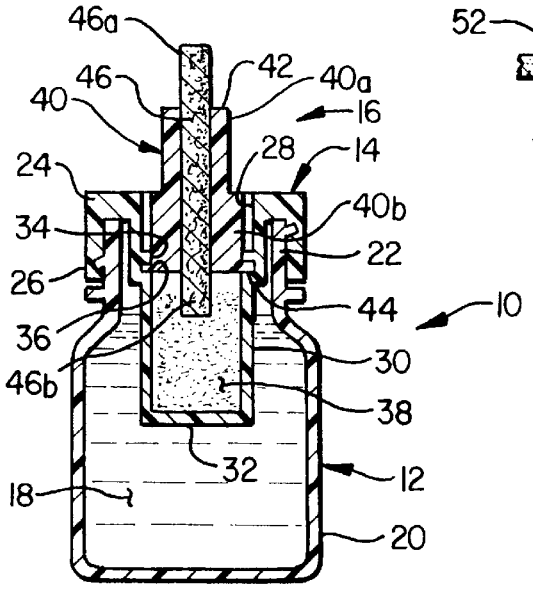
FIG. 2 is a cross-sectional view of the assembled device.

Illustrated in FIGS. 1 and 2 is an improved air-fuel aerial fireworks display device 10 that embodies principles of the present invention. FIG. 1 elevationally depicts the device 10 in an unassembled state, while FIG. 2 cross-sectionally shows the device 10 in an assembled, fueled and ready-to-use condition. The device 10 comprises three simple parts—a plastic bottle 12, a specially designed plastic lid 14, and a specially designed fuse and stopper structure 16.

The bottle 12 is formed from a suitable liquid impermeable plastic material and serves as a container for a combustible material, such as diesel fuel 18 or another combustible fuel such as gasoline (see FIG. 2), and has a body portion 20 and an open, externally threaded annular upper neck portion 22.

The plastic lid 14 has an annular upper end wall 24 from the periphery of which an internally threaded annular skirt 26 depends. Extending downwardly from the periphery of the central opening 28 in the annular upper end wall 24 of the lid 14 is an integral tubular well portion 30 of the lid 14. Well portion 30 extends downwardly past the lower side edge of the lid skirt 26 and has a closed lower end 32. For purposes later described herein, an annular interior rib 34 (see FIG. 2) is formed in an upper end portion of the well 30 somewhat above an annular, upwardly facing interior ledge 36 also formed within an upper end portion of the well 30. As best illustrated in FIG. 2, a lower end portion of the well 30, below the ledge 36, is adapted to internally receive a quantity of a low explosive material, representatively flash powder 38.

The fuse/stopper structure 16 includes a tubular plastic body section 40 having a tubular upper end portion 40*a* with an upper end 42, and a larger diameter tubular lower end portion 40*b* with a further enlarged diameter, relatively thin outwardly projecting annular flange 44 on its lower end. A suitable length of fuse 46 has a longitudinally intermediate portion thereof captively retained within the interior of the stopper body 40, with an upper end portion 46*a* of the fuse 46 projecting upwardly beyond the upper end 42 of the body portion 40*a,* and a lower end portion 46*b* of the fuse 46 projecting downwardly beyond the lower end flange 44.

To quickly assemble the improved fireworks display device 10, as shown in FIG. 2, the flash powder 38 is placed in the lower end portion of the lid well 30, and a lower end portion of the fuse/stopper structure 16 is pushed downwardly through the central lid opening 28 until the stopper flange 44 resiliently snaps into place between the internal flange and ledge portions 34 and 36 within an upper end portion of the well 30. This removably positions the lower stopper body end portion 40*b* centrally within the lid 14 and also (via the stopper flange 44) seals off the lower well end portion containing the flash powder 38. Alternatively, this removable, sealing placement of the stopper body over the flash powder-containing portion of the well 30 could be achieved by providing a threaded interconnection between the lower stopper body end portion and the interior side surface of the central lid opening 28. With the stopper 40 installed in the lid 14 in this manner, the upper fuse end portion 46*a* is exposed, while the lower fuse end portion 46*b* is received within the sealed-off lower interior portion of the depending lid well 30.

To complete the assembly of the device 10, the diesel fuel 18 (or other combustible fuel) is poured into the bottle 12, and the lid 14 is screwed onto the bottle neck 22 to form a threaded, sealed interconnection between the external threads on the neck 22 and corresponding threads on the interior side surface of the depending lid flange 26. As illustrated in FIG. 2, this immerses the flash powder-filled lower end portion of the well 30 within the combustible fuel 18.

According to a key advantage of the device 10, the liquid impermeability of the well 30 permits a single operator, at his leisure, to make up a whole series of the devices 10 for simultaneous use in a recreational fireworks display. In sharp contrast to conventional fireworks devices of this general type, with their required use of hot melt glued cardboard flash powder tubes and laborious constructions of glue seals at the bottle lid, the device 10 positively precludes the "soaking through" of the liquid fuel into the flash powder. Additionally, as can be seen from the foregoing description, compared to conventional air-fuel aerial fireworks display devices utilizing hot melt glue-sealed cardboard components, the device 10 may be much more rapidly and easily assembled and readied for launching. Moreover, no tedious hot gluing steps are required to operatively associate the fuse 46 with the flash powder 38.

Figure 3:
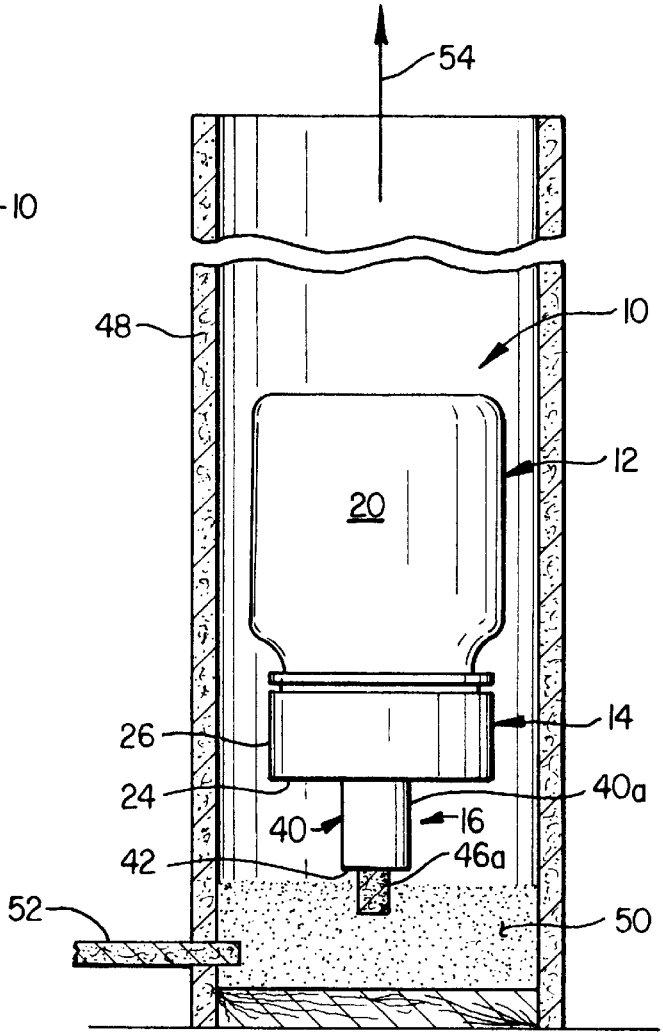
FIG. 3 is a partially elevational cross-sectional view illustrating the assembled device operatively placed in a representative mortar tube and ready for launching.

With reference now to FIG. 3, to use the assembled air-fuel aerial fireworks display device 10 of the present invention, the device 10 is simply inverted and dropped into the open top end of a conventional mortar-type cardboard launching tube 48 into a bottom interior end portion of which a suitable quantity of black powder 50 has been previously placed. A main fuse 52 extends inwardly through a bottom side wall portion of the launching tube 48 into the black powder 50 therein. Alternatively, the main fuse 52 could be routed downwardly through the open upper end of the tube 48 and into the black powder 50. With the inverted device 10 dropped into the launching tube 48 as shown in FIG. 3, the exposed fuse end portion 46*a* of the device 10 is disposed within the black powder 50.

To launch the assembled device 10, the main fuse 52 is lit to ignite the black powder 50 which, in turn, (1) ignites the device fuse end portion 46*a* and (2) launches the device 10 upwardly out of the upper end of the mortar tube 48 as indicated by the arrow 54 in FIG. 3. When the expelled device 10 is high in the air, its burning fuse 46 ignites the flash powder 38 (see FIG. 2) which creates a mid-air "salute" explosion. This salute explosion, in turn, ignites the diesel fuel 18 (see FIG. 2) to create a mid-air "fire ball".

The foregoing detailed description is to be clearly understood as being given by way of illustration and example only, the spirit and scope of the present invention being limited solely by the appended claims.

What is claimed is:

1. An aerial fireworks display device comprising:

a container adapted to receive a first combustible material and having an open end portion;

a lid structure having an upper portion removably and sealingly securable to said open end portion of said container, and a hollow well portion depending from said upper portion and adapted to receive a second combustible material, said hollow well portion having a closed lower end, and an upper interior portion that opens outwardly through said upper lid structure portion;

a plug member having top and bottom ends and an interior chamber opening outwardly through said top and bottom ends, a bottom end portion of said plug member being removably insertable downwardly into said upper interior portion of said well portion of said lid structure;

a heat-ignitable fuse having a longitudinally intermediate portion captively retained in said interior chamber of said plug member, a top end portion exposed at said top end of said plug member for ignition by a source of heat adjacent thereto, and a bottom end portion exposed at said bottom end of said plug member to ignite the received second combustible material within said hollow well portion subsequent to the heat ignition of said exposed top end portion of said heat-ignitable fuse; and cooperating means on said bottom end portion of said plug member and on said lid structure well portion for removably and sealingly retaining said bottom end portion of said plug member within said upper interior portion of said well portion of said lid structure.

2. The aerial fireworks display device of claim 1 wherein said hollow well portion of said lid structure is of a liquid impermeable material.

3. The aerial fireworks display device of claim 1 wherein said hollow well portion of said lid structure is formed integrally with said upper portion of said lid structure.

4. The aerial fireworks display device of claim 1 wherein said lid structure is of a one piece plastic construction.

5. The aerial fireworks display device of claim 1 wherein said container is a plastic bottle adapted to hold a combustible liquid.

6. The aerial fireworks display device of claim 5 wherein said upper lid structure portion is threadable onto said open end portion of said plastic bottle.

7. The aerial fireworks display device of claim 1 wherein said plug member has a generally tubular configuration.

8. The aerial fireworks display device of claim 1 wherein said plug member is formed from a plastic material.

9. The aerial fireworks display device of claim 1 wherein said bottom end portion of said plug member is releasably snap-fittable into said upper interior portion of said well portion of said lid structure.

10. The aerial fireworks display device of claim 1 wherein said cooperating means include:

an interior side surface projection formed in said upper interior portion of said well portion of said lid structure, and an exterior side surface projection formed on said bottom end portion of said plug member and being movable downwardly past said interior side surface projection into an underlying relationship therewith.

11. The aerial fireworks display device of claim 10 wherein:

said interior side surface projection is an annular interior flange, and said exterior side surface projection is an annular exterior flange.

12. The aerial fireworks display device of claim 11 wherein said upper interior portion of said hollow well portion of said lid structure has an upwardly facing annular ledge spaced downwardly apart from and generally coaxial with said annular interior flange.

13. An aerial fireworks display device comprising:

a plastic bottle adapted to receive a first combustible material and having, on an upper end portion thereof, an open threaded neck portion;

a one piece plastic lid structure having an upper portion threadingly securable to said neck portion, and a hollow well portion depending from said upper lid structure portion and adapted to receive a second combustible material, said hollow well portion having a closed lower end, and an upper interior portion that opens outwardly through said upper lid structure portion;

a plug member having top and bottom ends and an interior chamber opening outwardly through said top and bottom ends, a bottom end portion of said plug member being removably insertable downwardly into said upper interior portion of said well portion of said lid structure into a snap-fitted relationship therewith; and a heat-ignitable fuse having a longitudinally intermediate portion captively retained in said interior chamber of said plug member, a top end portion exposed at said top end of said plug member for ignition by a source of heat adjacent thereto, and a bottom end portion exposed at said bottom end of said plug member to ignite the received second combustible material within said hollow well portion subsequent to the heat ignition of said exposed top end portion of said heat-ignitable fuse.

14. The aerial fireworks display device of claim 13 wherein:

an interior side surface section on said upper interior portion of said well portion of said lid structure has a first projection formed thereon, and said bottom end portion of said plug member has a second projection formed on an exterior side surface thereof and being movable downwardly past said first projection, in an underlying relationship therewith, in response to insertion of said bottom end portion of said plug member into said upper interior portion of said hollow well portion of said lid structure.

15. The aerial fireworks display device of claim 14 wherein each of said first and second projections is an annular flange.

16. The aerial fireworks display device of claim 15 wherein said upper interior portion of said hollow well portion of said lid structure has an upwardly facing annular ledge spaced downwardly apart from and generally coaxial with said first projection.

* * * * *